US009994412B1

(12) United States Patent
Gulik

(10) Patent No.: US 9,994,412 B1
(45) Date of Patent: Jun. 12, 2018

(54) DISPENSER FOR ROLLED FOIL AND WALL ASSEMBLY OF SAME

(71) Applicant: Ryszard Gulik, Cocoa, FL (US)

(72) Inventor: Ryszard Gulik, Cocoa, FL (US)

( * ) Notice: Subject to any disclaimer, the term of this patent is extended or adjusted under 35 U.S.C. 154(b) by 0 days. days.

(21) Appl. No.: 15/445,250

(22) Filed: Feb. 28, 2017

(51) Int. Cl.

| | |
|---|---|
| ***B65H 35/06*** | (2006.01) |
| ***B65D 83/08*** | (2006.01) |
| ***B65H 35/00*** | (2006.01) |
| ***B65D 85/672*** | (2006.01) |

(52) U.S. Cl.
CPC ..... *B65H 35/0006* (2013.01); *B65D 83/0805* (2013.01); *B65D 85/672* (2013.01); *B65D 83/0847* (2013.01); *B65H 35/002* (2013.01); *B65H 35/008* (2013.01); *Y10T 225/285* (2015.04); *Y10T 225/291* (2015.04); *Y10T 225/297* (2015.04)

(58) Field of Classification Search
CPC ..... Y10T 225/297; Y10T 225/284; Y10T 225/291; Y10T 225/285; B65H 35/0006; B65H 35/002
USPC ..... 225/77, 79, 80, 84
See application file for complete search history.

(56) References Cited

U.S. PATENT DOCUMENTS 320,576 A * 6/1885 Myers ..... B65H 35/0006 225/85
1,038,150 A * 9/1912 King ..... B65H 35/0006 225/72
1,063,787 A * 6/1913 Evans ..... A47K 10/38 225/79
1,101,566 A * 6/1914 Rice ..... B65H 35/0006 225/68
1,231,415 A * 6/1917 Van Bibber Nebergall ..... B65H 35/0006 225/20
1,270,580 A * 6/1918 Wolf ..... B65H 35/0026 225/33
1,299,087 A * 4/1919 Winterhalter et al. ..... B65H 35/0006 225/15
2,156,502 A * 5/1939 Lawton ..... B65H 35/0006 225/15

(Continued)

*Primary Examiner* — Laura M Lee

(57) ABSTRACT

The present invention refers to the apparatus for storage and dispensing foil from the roll, and also to the wall attachment for placement of multiple dispensers in vertical dispenser system for rolled materials, where two side walls and one back wall of dispenser's body, perpendicular to the floor, enclose the storage space for the material from three sides, while fixedly attached cutting assembly provides the fourth wall. The elongated slot located close to the back wall in the floor of the dispenser base interacts with gravitationally working pivoting latch of the mounting wall frame in the vertical dispenser system to secure placement of installed apparatus on the wall frame. Top rotatable attached to the side walls of the container, while lifted from horizontal position by handle tab, reveals the free end of foil on top of the shroud that remains ready for picking and pulling from the roll in container anytime the top is lifted from horizontal position and then cut by pulling farther the unwound foil while bottom edge of top's body tab pushes foil below the cutting blade, and also frictionally holds the foil between shroud and top's body tab, therefore the foil, pulled farther, engages with serration of the cutting blade due to the intervening position of the said blade in relation to pulling direction.

9 Claims, 7 Drawing Sheets

(56) References Cited

U.S. PATENT DOCUMENTS

| | | | | | |
|---|---|---|---|---|---|
| 2,470,250 | A * | 5/1949 | Kienle | H02G 1/02 | 224/255 |
| 2,475,882 | A * | 7/1949 | De Capite | B44C 7/025 | 242/598.5 |
| 2,751,163 | A * | 6/1956 | Waltz | B65H 35/002 | 225/21 |
| 4,579,267 | A * | 4/1986 | Planke | B65H 35/002 | 225/19 |
| 5,651,487 | A * | 7/1997 | Hansen | A47K 10/38 | 225/106 |
| 8,142,341 | B1 * | 3/2012 | Salvesen | A45D 19/00 | 493/356 |

* cited by examiner

DISPENSER FOR ROLLED FOIL AND WALL ASSEMBLY OF SAME

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

The present invention relates to a dispenser of material from the roll and, more particularly to a stretchable and clinging foil, like saran wrap, but also aluminum or waxed paper that accommodates the need of cutting off designated lengths from the roll in household and commercial environments.

2. Description of Related Art

Dispensers for rolled foil are well known in the art and consecutive innovations address difficulty in arriving with an effective method to separate desired length of material from a roll. The known art relates to the method of dispensing and cutting rolled material. Some of the innovations represent U.S. Pat. Nos. 4,598,531, 6,039,102, 6,786,376, 6,915,935, and 6,929,213.

U.S. Pat. No. 4,598,531 discloses cutting element that is normally in guarded position until drawn material causes the cutting edge to withdraw into cutting position. Mechanism with reduced number of interacting and moveable parts and the cutting apparatus that would not be vulnerable to jamming, will be improvement in the art.

U.S. Pat. No. 6,039,102 and U.S. Pat. No. 6,786,376 disclose axially rotating cutting edge of which accidental contact with operator hand is prevented by manually operated retaining member. The apparatus that assures indisputable safety of the operator in contact with cutting blade better controls of the tension of the unwound foil and enclosures of the roll of foil inside the frame that may be mounted to the surface will be improvement in the art.

U.S. Pat. No. 6,915,935 discloses dispensing system that incorporates two parts in the process of material separation: the first part is stationary in the form of tray for the material roll, and the second part is in the form of rotatable cover. The friction between roll of material and the body of bottom tray prevents the roll to unwound irrespectively of winding direction. Exposed cutting apparatus placed alongside the edge of the tray creates the danger of injury. Rubber strip over time changes properties and becomes slippery and therefore ineffective. The apparatus that ameliorates the said inefficiencies will be an improvement in the art.

U.S. Pat. No. 6,929,213 discloses dispenser with protective roller placed above the sharp edge. Apparatus with sharp edge placed in more protruded position to enhance serration of the material while retaining safe operation would be an improvement in the art.

Other improvements in foil dispenser for home or commercial use would be desirable. Rolls of wrapping and lining materials are offered by manufacturers in carton boxes equipped with serrated edges. The current method of dispensing foil from the roll in manufacturer's packaging is to draw the desired length from open box, to close the container with the box top, and to engage the foil with the cutting edge provided along one of the walls or the top, while in other hand to hold the box with remaining foil. Cutting blade becomes dislodged when container is used for prolonged time as a dispenser, and thus cutting function becomes inefficient or impossible. It is common to cut fingers while fumbling for the end of foil inside the container or grabbing the box from the drawer when cutting strip is already partly separated from the box. It is important to acknowledge the fact, that elastic material, like saran wrap, has the tendency of curling, wrinkling, edge deformation, and clinging to the roll while forcibly pulled on by one hand, therefore reducing efficiency of the cutting strip and increasing difficulty in peeling the end of sheet from the roll. Also, the strip that is dull or incorrectly positioned in relation to the foil, deems the dispensing apparatus useless. Process of finding the broken end of material clinging to the roll inside the container has to be repeated with every draw of foil. When the packaging box ceases to work as the dispenser, rolled material can be cut only by following the order in which the box has to be opened, the desired length of the sheet to be disentangle and placed on the surface, the unwind sheet to be securely held against the staging surface i.e. by forearm of one hand, and then cut with sharp knife with the other hand. Therefore dispensing foil from the storage box requires both hands, free flat staging space, and additional cutting tool. Unreliable cutting apparatus of container causes consumer aggravation, material waste, and may lead to injury.

Therefore, it is apparent that an apparatus that will be reliable and safe while dispensing the foil is needed.

BRIEF SUMMARY OF THE INVENTION

The present invention briefly describes the preferred embodiment of the apparatus for storage and dispensing foil from the roll, and also discloses the wall attachment for placement of multiple dispensers in vertical dispenser system for rolled materials.

The base of the apparatus consists of flat floor surface, the back wall, and two side walls. Back wall and two side walls are perpendicular to the floor in the same direction, and together with the floor enclose the storage space for the material from four sides. Side walls provide the means to attach the shaft for the roll, rotatable top working as a stopper for the unwound material, and fixedly attached cutting assembly. Such assembled apparatus becomes a container for the rolled foil. The elongated slot located along the back wall in the floor of the dispenser base interacts with gravitationally working pivoting latch of the mounting wall frame in the vertical dispenser system to secure placement of apparatus installed on the wall frame.

Top of the container pivotally attached to the side walls of the base, while lifted from horizontal position by handle tab, reveals the free end of foil on top of the shroud, where it was placed in preceding dispensing operation, and remains ready for picking and pulling from the roll. To cut the consecutive length of foil, drawn from the roll in container while top is lifted from horizontal position, the top has to be placed back in horizontal position, where bottom edge of top's body tab puts foil below the cutting blade and frictionally holds the foil between shroud and top's body tab. The foil, while pulled farther, engages with serration of the cutting blade due to the intervening position of the said blade in relation to pulling direction, and therefore causing the pulled length of foil to be cut. After each cutting operation the free end of foil roll remains on top of shroud for easy access for consecutive cut. Slots in the body tab are aligned with side walls of the base and allow to drive the body tab below the cutting blade, while handle tab of top covers the space where sharp edge of cutting blade is located.

The cutting assembly consists of two pieces of bars with triangular cross section, that enclose cutting blade placed between lower bar and upper bar in such way that the cutting blade is positioned in an angle to the planar face of the container floor. The cutting assembly contains a shroud that is attached to the bottom of the lower bar for holding the cut end of material away from the roll for easy separation, and also works as a stopper during cutting off the unwound foil. The cutting assembly is fixedly attached to the side walls of the base in the front, therefore becomes the fourth wall of the container.

A shaft for rotational placement of the rolled material eliminates friction between the foil and container parts, allowing an uninterrupted dispensing of the sheet without curling, wrinkling, edge deformation, and clinging to the roll. The shaft incorporates three elastic ribs in symmetrical sinusoidal shape that are spaced tangentially every 120 degrees along the shaft in circumferential mode. Elastic ribs, each having two apexes, provide three pairs of self-adjusting contact points, therefore keeping the roll centrally on the shaft regardless of the core diameter. The shaft assembly is pivotally connected with side walls of the container base, and the shaft is accessible only when the top is in vertical position.

Frame of the wall mount of vertical dispenser system for multiple dispensers consists of shallow channel in which cutouts in the channel legs form support ledges and catches that are placed vertically in a distance from each other, where ledges cutouts support base of dispenser body, while catches secure the top edge of the container's back wall in vertical position, therefore ledges and catches cutouts together provide means of attaching the foil dispenser with the frame of the wall mount. A latch in a form of elongated flat arm is pivotally attached to the wall mount frame and held in vertical position by gravitational forces incorporated in the design of the pivoting latch, where longer end of the arm is equipped with a knob, while the opposite shorter end of the arm is not. The knob's free shorter end of the pivoting latch's arm engages with the elongated slot of the dispenser's base, therefore dispenser is held in secure position while connected with the wall mount frame through the ledges and catches. To disengage the dispenser from the wall mount frame, the end of the latch arm with the attached knob has to be rotationally lifted until the pivoting latch arm assumes horizontal position and therefore to disengage from the slot in the container floor. Frame of the wall mount can be attached to the vertical surface through provided perforations in the frame base. Unused ledges and catches cutouts stay covered by the sleeves to prevent injury until the next dispenser is installed in such provided space in the said wall mount.

Blanks of container parts and wall mount are cut from planar stainless steel sheet in a pattern reducing material waste. All parts of disclosed apparatus in preferable embodiment are made from stainless steel to assure lifelong reliability of the product. Shroud body in preferable embodiment is made from higher gauge stainless steel, that is translated as thinner steel, and retains elastic properties in frequent use.

BRIEF DESCRIPTION OF THE DRAWINGS

Descriptions of the drawings for the present exemplary foil dispenser and wall assembly provide consistent reference with numerals and lettering denoting similar elements throughout, including isometric views of parts and referenced fragments.

A—is the dispenser assembly with top in closed position,

B—is the dispenser assembly with top in foil draw position, and

C—is the dispenser assembly ready to receive the foil roll.

Drawings are provided solely for the purpose of illustration and they are not intended to limit disclosure to any or all of the exact details of the design shown, except being essential to explain structural functionality of the preferred embodiment in provided disclosure for listing claims.

DETAILED DESCRIPTION

Use of actual terminology to describe exemplary and preferable embodiment of the present disclosure as illustrated in FIGS. 1-16 is not intended to exclude any or other technical terminology or limit processes or shapes to describe similar products which may lead to the accomplishment of similar function and is limited only by the listed claims.

Figure 1:
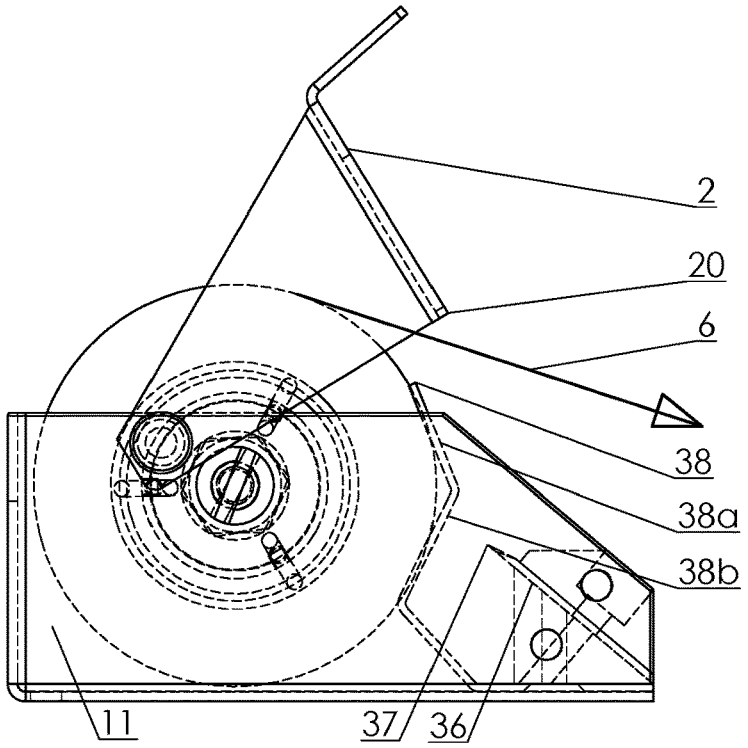
FIG. 1 is a schematic side view of the dispenser with top raised for drawing a foil.

Referring to FIG. 1, example embodiment of foil dispenser disclosed in schematic side view illustrates position of the foil sheet 6 drawn from the roll in relation to the bottom edge of top body tab 20 of top 2 and sharp edge 37 of cutting blade 36, where end of the foil can be lifted from the face 38*a* of shroud 38, while the shroud face 38*b* prevents injury being in close proximity of the cutting blade 36. Shaft with roll of foil sheet 6 and top 2 are set rotationally in the side walls 11 of container while sharp edge 37 remains stationary.

Figure 2:
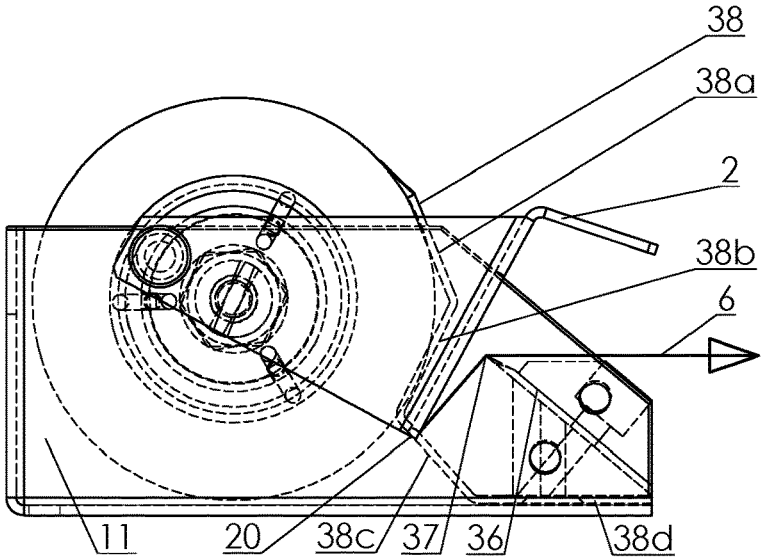
FIG. 2 is a schematic side view of the dispenser with top lowered for cutting a foil.

Referring to FIG. 2, example embodiment of foil dispenser disclosed in schematic side view illustrates relative positions of the top 2, cutting blade 36, and the foil sheet 6 that is about of being cut. The bottom edge of top body tab 20 of top 2 in downward move draws and holds the foil sheet 6 below the cutting blade 36 and against the face 38*c* of shroud 38. Pulling the foil farther out engages the foil sheet 6 with sharp edge 37 of cutting blade 36 resulting in separation of the foil sheet 6 from the roll along the length of cutting blade 36. Pressure exerted on face 38*c* by top 2 causes face 38*a* and face 38*b* of shroud 38 to remain in contact with surface of roll of foil sheet 6 irrespectively of the amount of foil sheet 6 remaining on the roll, and works as a break whenever foil sheet 6 is pulled away to be cut.

Figure 3:
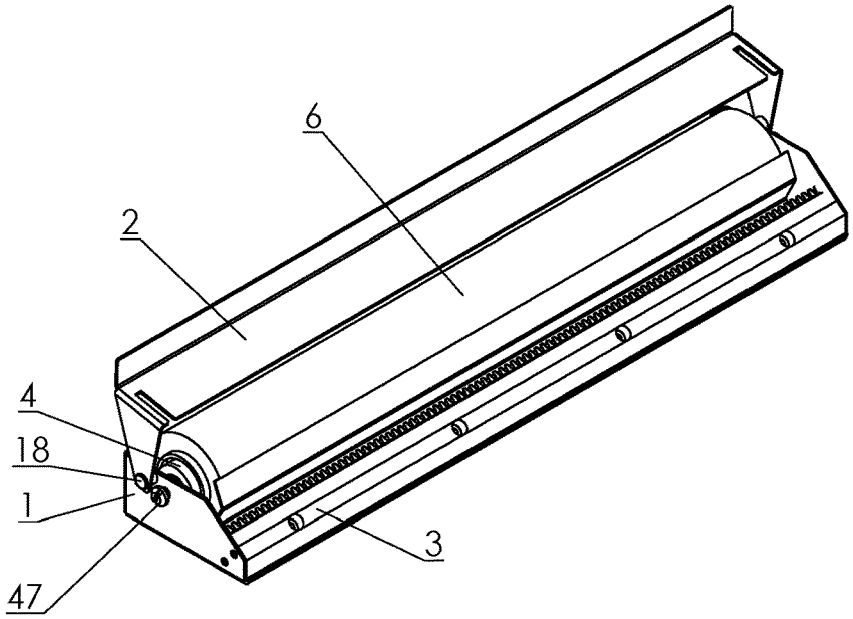
FIG. 3 is an isometric view of the dispenser assembly.

FIG. 3 displays example embodiment of foil dispenser in opened position indicating container base 1, top 2, cutting assembly 3, shaft assembly 4, and rolled foil sheet 6, where pivot 47 of the shaft assembly 4 is accessible only while top 2 is in vertical position.

Figure 4:
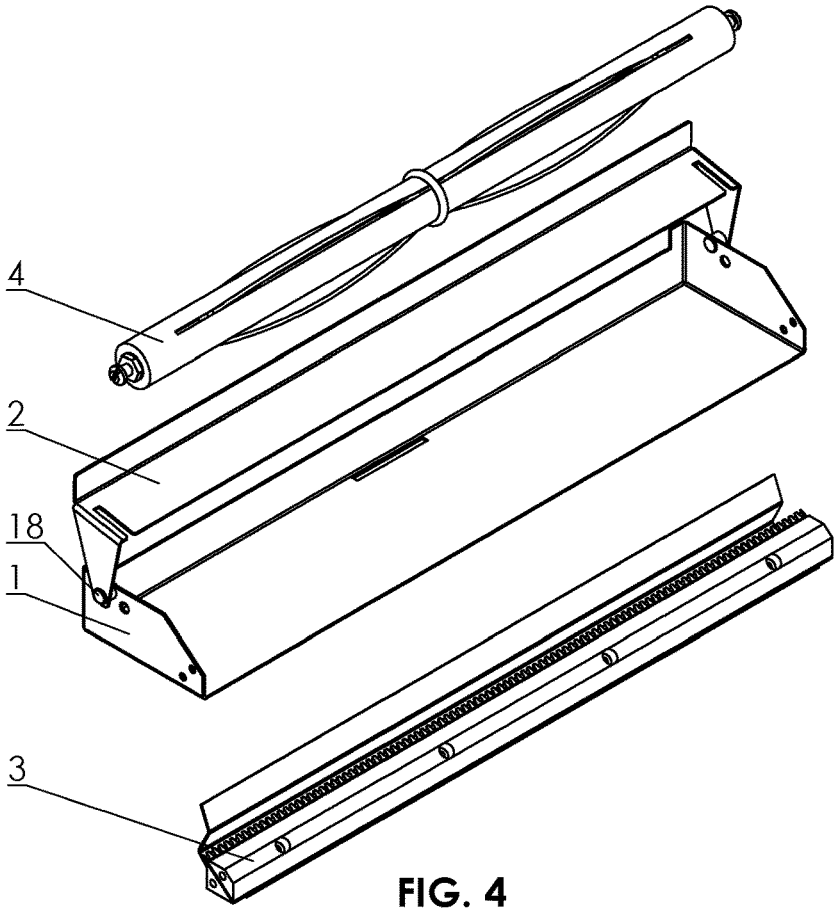
FIG. 4 is an isometric view of the exploded dispenser assembly.

FIG. 4 displays example embodiment of foil dispenser in exploded isometric view indicating container base 1, top 2, cutting assembly 3, and shaft assembly 4.

Figure 5:
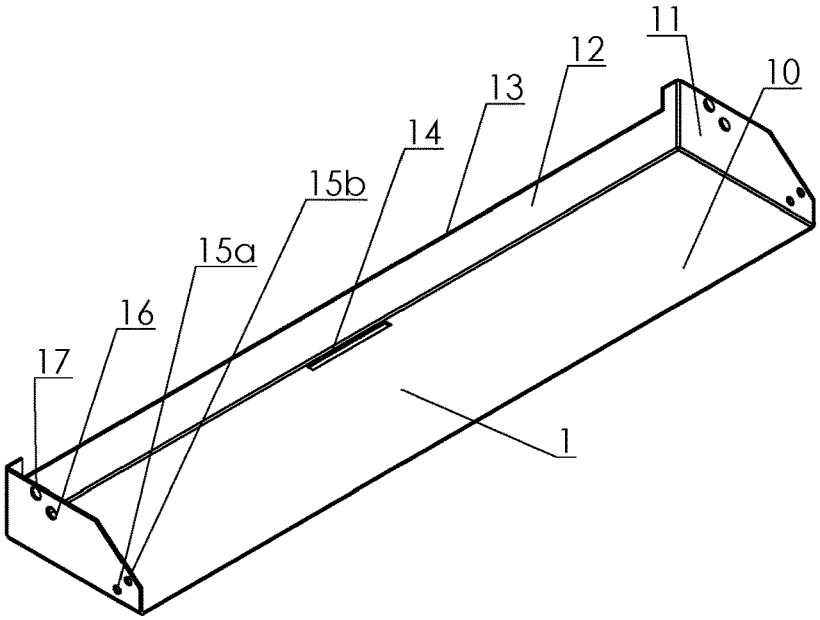
FIG. 5 is an isometric view of the dispenser base.
Figure 16:
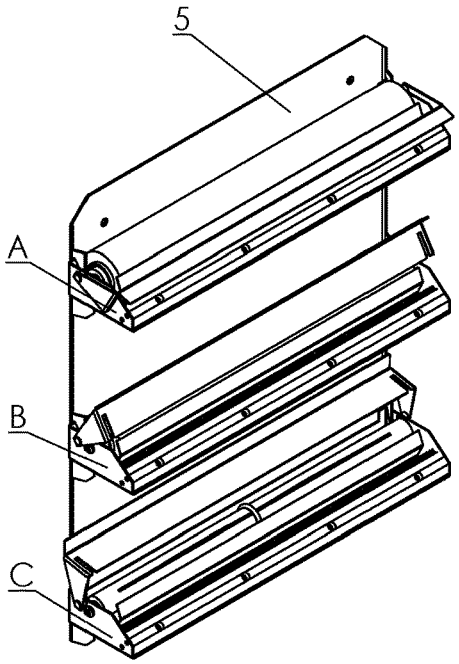
FIG. 16 is an isometric view of the vertical dispenser system with three dispensers where.

FIG. 5 illustrates in isometric view example of foil dispenser in preferable embodiment with indication of parts and features instrumental in correct functioning of the apparatus when assembled together. Container body 1 in preferable embodiment made of stainless steel consists of base flat face 10 that has two shorter extensions bent upwards and acting as side walls 11, and has one long extension bent also upwards and acting as back wall 12. Both bends are preferably welded together along the common edge in the corners at the back wall. Back wall 12 has a longitudinal cutout 13 at the top edge to allow installation of the rolled foil sheet 6. The slot 14 centrally located between side walls 11 on the base flat face 10 close to the back wall 12 interacts with pivoting latch 55 of the wall frame 5 to secure placement of dispenser in vertical dispenser system's wall assembly as depicted in FIG. 16. Two perforations 15*a* and 15*b* placed at the lower end of side walls 11 are provided to fasten cutting assembly 3 with container body 1, where lower perforation 15*a* corresponds with perforation 31 of lower bar 30 in FIG. 8, while upper perforation 15*b* corresponds with perforation 35 of upper bar 34 in FIG. 9. Two perforations 16 and 17 are placed at each side of the higher end of side wall 11, where perforation 16 provides rotational fastening for shaft assembly 4 through the pivot 47 in FIG. 12, while perforation 17 provides rotational fastening for top 2 through the perforation 24 in FIG. 6.

Figure 6:
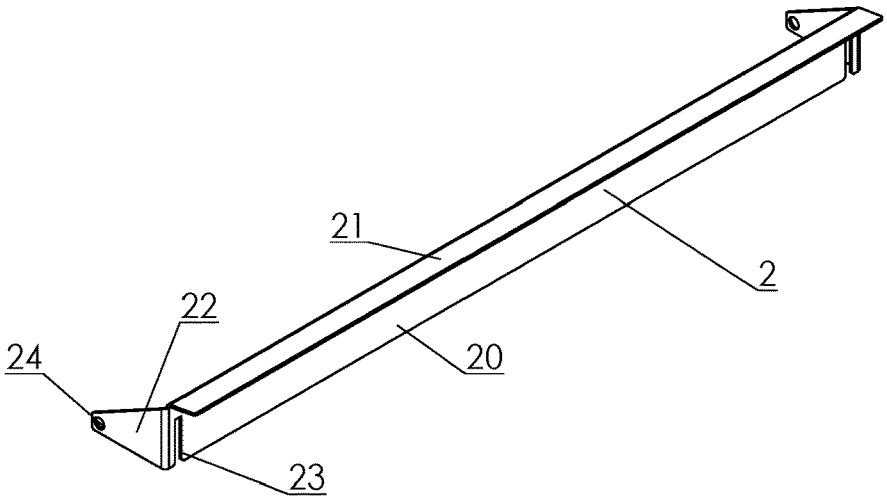
FIG. 6 is an isometric view of the dispenser top.

FIG. 6 illustrates example embodiment of foil dispenser top 2 in isometric view with indication of parts and features instrumental in correct functioning of the apparatus in assembly of the dispenser. Top 2 in preferred embodiment made of stainless steel consists of flat top body tab 20 that has one long extension bent forward and acts as a handle tab 21, and two shorter extensions bent backwards and act as top arms 22. Body tab 20 has elongated cutouts 23 located close to the top arms 22 that overlap side walls 11 of the container body 1 when engaged in foil cutting process. Top arms 22 have perforations 24 that match perforations 17 in the higher end of each side wall 11 of the container body 1 in FIG. 5 that allow to connect top 2 with body 1 using rivets acting as an axis 18" in FIG. 3 and FIG. 4 of sheet 2 of 7.

Figure 7:
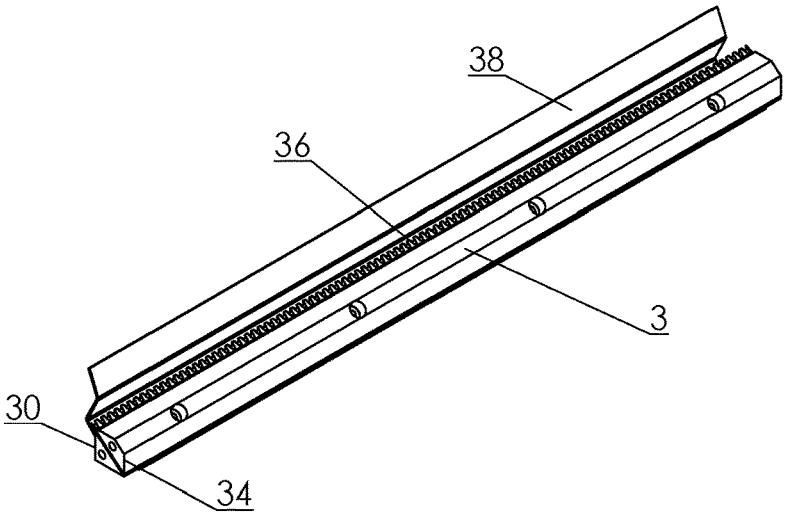
FIG. 7 is an isometric view of the cutting assembly.
Figure 8:
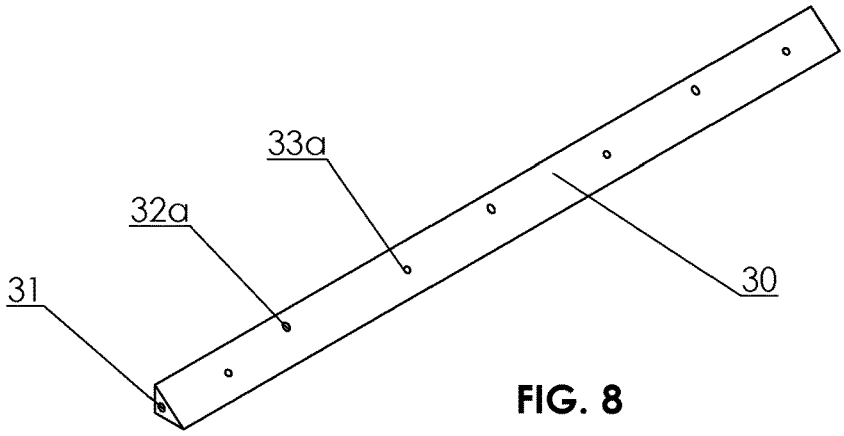
FIG. 8 is an isometric view of the lower bar of the cutting assembly.

FIG. 7 illustrates example embodiment of foil cutting assembly 3 in isometric view which consists of lower bar 30, upper bar 34, cutting blade 36, and shroud 38, where lower bar 30 and upper bar 34 with cutting blade 36 are held together by fasteners utilizing corresponding perforations 33*a*, 33*b*, and 33 respectively in all three said parts, while shroud 38 is attached to lower bar 30 utilizing perforations 32*a* as shown in FIG. 8.

FIG. 8 illustrates example embodiment of lower bar 30 in isometric view with indication of features instrumental in correct functioning of the apparatus when assembled in foil cutting assembly 3. Lower bar 30 has three kinds of perforations where first kind namely perforations 33*a* corresponds with perforations 33*b* in upper bar 34, and perforation 33 in cutting blade 36, like in FIG. 10, resulting in holding cutting blade 36 between lower bar 30 and upper bar 34, like in FIG. 7, second kind namely shroud perforations 32 corresponds with lower bar 30 perforations 32*a* resulting in holding shroud 38 with lower bar 30, and third kind namely side perforation 31 matches location of the lower perforation 15*a* in side wall 11 in FIG. 5, resulting in fastening lower bar 30 of cutting assembly 3 to the side walls 11 of the container body 1 in FIG. 5.

Figure 9:
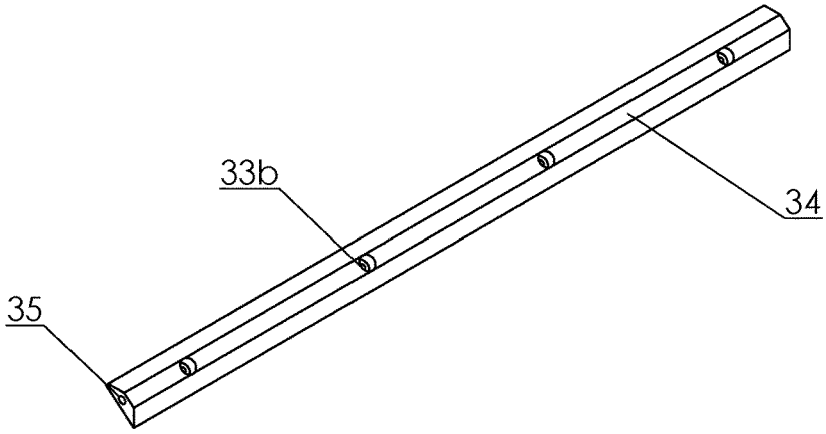
FIG. 9 is an isometric view of the upper bar of the cutting assembly.

FIG. 9 illustrates example embodiment of top bar 34 in isometric view with indication of features instrumental in correct functioning of the apparatus when assembled in a foil cutting assembly 3. Top bar 34 has two kinds of perforations, where first kind namely cutting blade perforations 33*b* corresponds with perforations 33*a* in lower bar 30, and perforations 33 in cutting blade 36, resulting in holding cutting blade 36 between lower bar 30 and upper bar 34, like in FIG. 7, while second kind namely side perforations 35 matches location of the upper perforation 15*b* in side wall 11 in FIG. 5, resulting in fastening upper bar 34 of the cutting assembly 3 to the side walls 11 of the container base 1 in FIG. 5.

Figure 10:
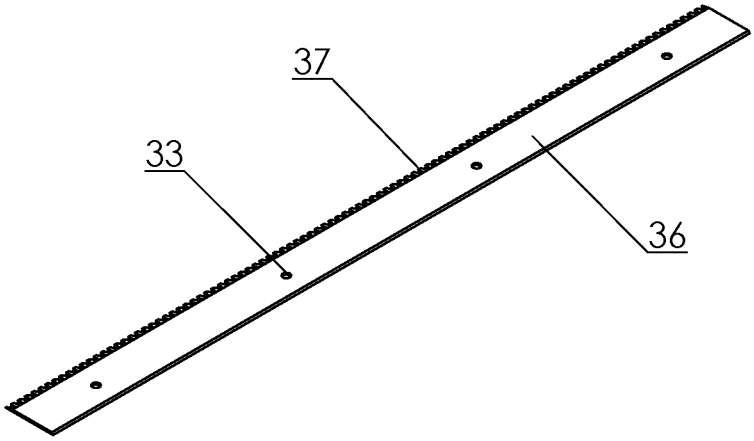
FIG. 10 is an isometric view of the cutting blade.

FIG. 10 illustrates example embodiment of cutting blade 36 in isometric view with indication of features instrumental in correct functioning of the part when incorporated in the foil cutting assembly 3. Perforations 33 in cutting blade 36 are aligned with perforations 33*a* in lower bar 30 and perforations 33*b* in upper bar 34, therefore cutting blade 36 is sandwiched and fixedly held between lower bar 30 and upper bar 34. Cutting blade 36 in preferred embodiment of the stainless steel flat strip has substantial serration with pointed and sharpened cutouts along sharp edge 37.

Figure 11:
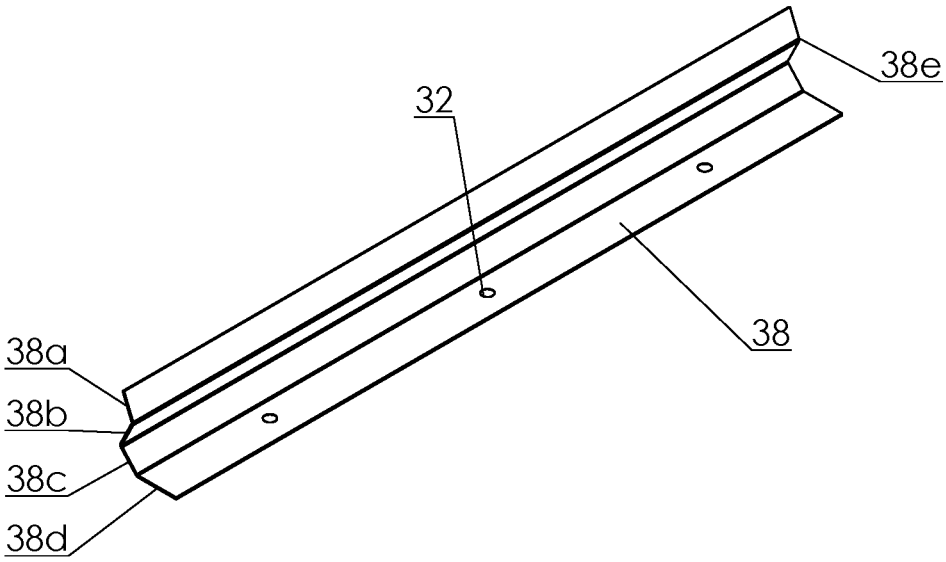
FIG. 11 is an isometric view of the shroud.

FIG. 11 illustrates example embodiment of shroud 38 in isometric view with indication of features instrumental in correct functioning of the part when incorporated in the foil cutting assembly 3. Shroud 38 in preferable embodiment made of higher gauge translated as stainless steel strip thinner than used for container body 1 and the top 2, therefore being pliable and elastic, has four distinctive faces important for correct operation of the apparatus where each face functions adequately:

- contact face 38*a* separates the unwound foil from the rolled foil sheet 6 and holds the cut end of foil to be freely lifted and pulled for consecutive dispensing;
- overlapping face 38*b* functions as a security shield for the sharp edge 37 of the cutting blade 36 and the bend ridge 38*e* clinches and holds the top body tab 20 and rolled foil sheet 6 between contact face 38*a* and overlapping face 38*b*, when the rolled foil sheet 6 is drawn down from the roll by body tab 20 for dispensing;
- stop face 38*c* functions as a counter face for bottom edge of top body tab 20 to hold rolled foil sheet 6 in fixed position. Due to elastic properties of the shroud 38, every time stop face 38*c* is in contact with bottom edge of top body tab 20, the top edge of the stop face 38*a* is reactively pressed against the surface of the rolled foil sheet 6 and thus prevents foil to unwind from the roll during cutting process;

base face 38*d* functions as a base having perforations 32 to fasten shroud 38 with the bottom bar 30 in cutting assembly 3.

Figure 12:
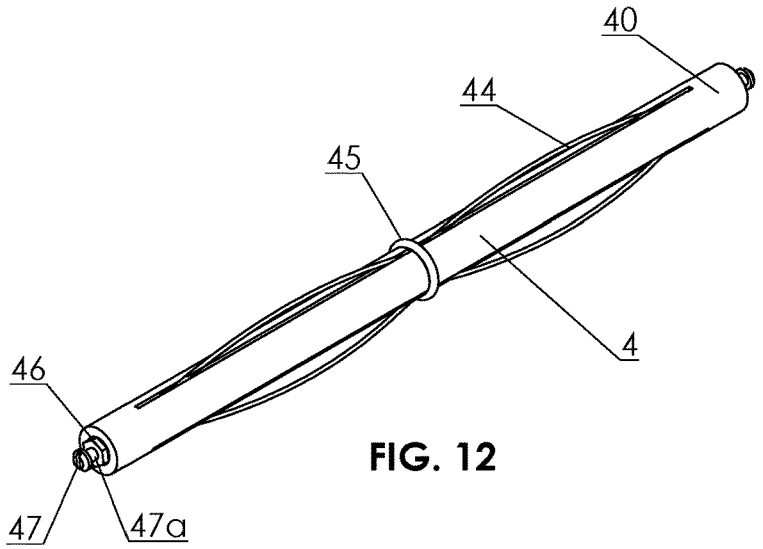
FIG. 12 is an isometric view of the shaft assembly.

FIG. 12 illustrates example embodiment of shaft assembly 4 in isometric view with indication of features instrumental in correct functioning of the parts. Body 40 of the shaft assembly 4 is in the shape of elongated round with three elastic ribbings 44, that are secured by elastic band 45 located at the middle of the body length. Both extreme ends of the shaft body 40 are equipped with one threaded insert 46, and one pivot 47 that use the thread in the threaded insert 46 to provide rotational connection between the shaft assembly 4 and container base 1 in FIG. 3.

Figure 13:
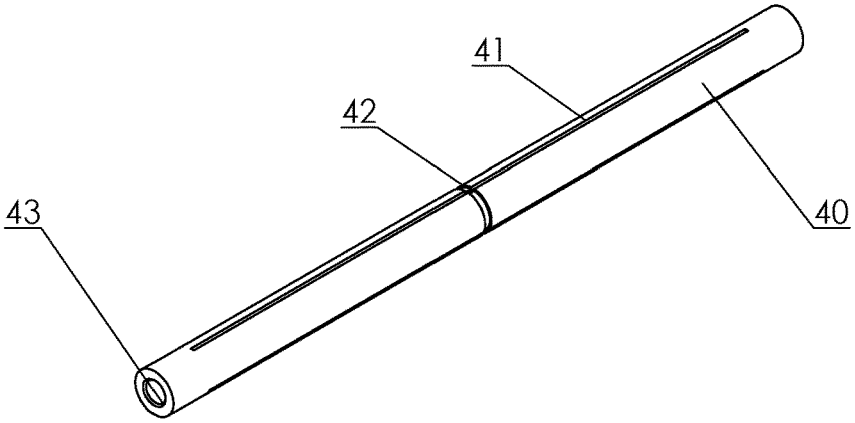
FIG. 13 is an isometric view of the shaft body.

FIG. 13 illustrates example embodiment of shaft body 40 in isometric view in a shape of elongated round having two types of grooves, where the first type is in the shape of three longitudinal grooves 41 that are placed tangentially on the surface of the round and concentrically spaced at 120 degrees from each other for placement of elastic ribbing 44 that are shorter than the longitudinal grooves 41, while the second type is circumferential groove 42 placed in the middle length of the shaft body 40 for placement of elastic band 45, preferably in the shape of O-ring, to hold the elastic ribbing 44 at the center and allowing only the ends of the elastic ribbing 44 to move outward in the longitudinal groove when being depressed at the apex of the bend. Shaft body 40 has cylindrical opening 43 at each end for threaded insert 46 to accommodate pivot 47, preferably in the form of shoulder bolt with thread matching inner thread of insert 46 of shaft assembly 4.

Figure 14:
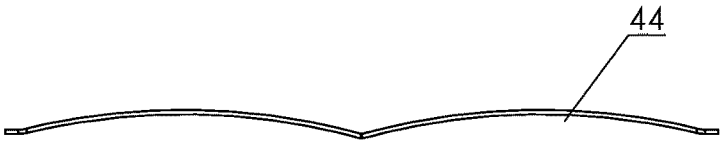
FIG. 14 is an isometric view of the elastic rib.

FIG. 14 illustrates the elastic ribbing 44 in front view that has a half-sinusoidal shape and is symmetrical at the middle, where is held in the circumferential groove 42 by the elastic band 45 with the shaft 40. The apex of the bend, while being depressed, causes the extreme end of elastic ribbing 44 to move away from the fixed center position and thus avoiding damage to elastic ribbing 44, therefore allowing any core of rolled foil sheet 6, irrespectively of diameter, when placed on three identical elastic ribbings 44 to be always positioned centrally on the shaft assembly 4.

Figure 15:
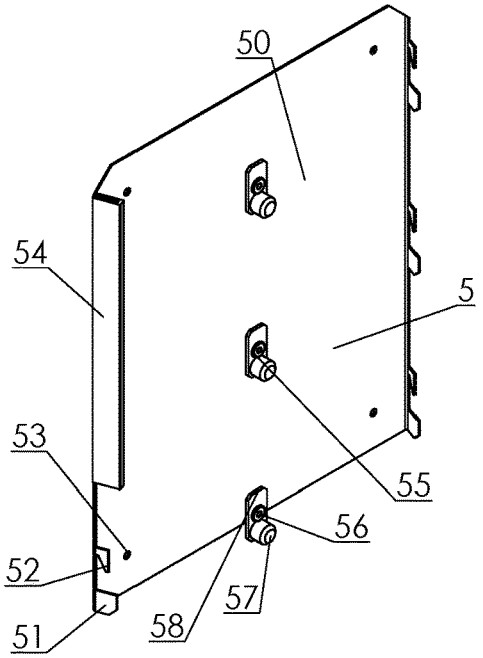
FIG. 15 is an isometric view of the wall mount frame of vertical dispenser system.

FIG. 15 illustrates example embodiment of the wall mount frame 5 of vertical dispenser system in isometric view that accommodates multitude of dispensers described in detail and referenced in FIGS. 1-14. Body 50 of wall mount frame 5 in preferable embodiment as stainless steel channel, with legs cut symmetrically to provide ledges 51 and catches 52 are equally spaced on both legs of channel and function as attachment fixtures for number of dispensers. Pivoting latch 55 is placed on the body 50 of the channel web in the middle of the wall mount frame 5 body in between each corresponding pair of support ledges 51 and catches 52 and below ledges 51. Pivoting latch 55 consists of flat latching arm 58 having pivot 56 and knob 57, where knob 57 is attached at one extreme of the flat latching arm 58, therefore the pivoting latch 55 is always imbalanced due to gravitational force created by the weight of knob 57 causing the flat latching arm 58 to stay in vertical position, and therefore engaging dispenser assembly through the slot 14 in flat face 10 of the container body 1, when dispenser is placed between support ledges 51 and catches 52 on the wall mount frame 5. Pivoting latch 55 has to be rotated by hand to horizontal position for releasing dispenser assembly from the wall mount frame 5 for individual use. Wall mount frame 5 can be attached to vertical structure through the perforations 53 provided in the body 50 of the channel web. Sleeves 54 are placed for safety purpose over support ledges 51 and catches 52 while not used by dispenser.

FIG. 16 illustrates example embodiment of wall dispenser system in isometric view comprising of mount wall frame 5 with three dispensers described in detail and referenced in FIGS. 1-14. Top dispenser A in an inactive status is displayed with top 2 in closed position, therefore top 2 is blocking an access to the rolled foil sheet 6 and covering an aperture in which the cutting blade 36 resides, therefore preventing accidental injury. Middle dispenser B is displayed in foil drawing position with lifted top 2 allowing to grab the foil from the contact face 38*a* of the shroud 38 and to pull desired length of foil from the rolled foil sheet 6. Lowering the top 2 until the bottom edge of top body tab 20 touches the stop face 38*c* of shroud 38 and pulling farther the unwound foil cause cutting the desired length by sharp edge 37 of the cutting blade 36 as illustrated in FIG. 2, and afterward leaving dispenser B in inactive status of dispenser A.

Bottom dispenser C is displayed without the rolled foil sheet 6 where shaft assembly 4 can be removed from the container base 1 by disconnecting pivots 47 accessible only while the top 2 is placed in vertical position. Shaft assembly 4 after being inserted inside the core of the rolled foil sheet 6 replacement may be installed back inside the container body 1 by connecting pivots 47 through the perforations 16 in the side walls 11 of the container body 1. Lowering top 2 into horizontal position put the dispenser C in the inactive status of dispenser A.

The above embodiment of the invention of the dispenser for rolled foil and wall assembly, in which the scope of the invention being described and illustrated hitherto, is determined only by the appended claims, therefore variations in the materials and techniques utilized in construing the apparatus, when obvious and known by the person knowledgeable in the subject, deems invention valid.

What is claimed is:

1. A rolled foil dispenser for manually dispensing of a pre-determined length of sheet material, the rolled foil dispenser comprising:

a container body having a base flat face, a back wall, and two side walls each having perforations;

a top having a body tab, a handle tab extending upward from a back edge of the body tab, a first top arm extending upward from a first side edge of the body tab, and a second top arm extending upward from a second side edge of the body tab, the first top arm and the second top arm having perforations and are each axially connected to the container body by a respective rivet that allows rotational connection between the two side walls of the container body and the top, wherein the body tab is positionable between a first position in which the predetermined length of the sheet material is drawn from a foil roll and a second position in which the body tab is beneath a sharp cutting edge of a cutting blade and the lower edge of the body tab holds the predetermined length of the sheet material against an overlapping face of a shroud, wherein a distance between the cutting blade and the body tab in the first position is larger than a distance between the cutting blade and the body tab in the second position, and the handle tab in the second position covers a space at the front of the container near the cutting blade;

a cutting assembly having an upper bar, a lower bar, said shroud, said cutting blade, and means for securing the cutting blade to the upper bar and the lower bar, wherein the cutting assembly is attached to the front of the container body, the cutting blade extends between the upper bar and lower bar, and the lower bar is attached to the shroud;

a shaft assembly having a round shaft body with grooves, each groove accommodating a respective elastic ribbing formed of a symmetrical half sinusoidal shape, and wherein each ribbing is secured by an elastic band at the middle of the shaft, both ends of the round shaft body are each configured to receive a threaded insert, and each one of said threaded inserts is configured to receive a pivot.

2. The rolled foil dispenser of claim 1, wherein the container body is cut from a flat stainless steel sheet and is formed by press break operations.

3. The rolled foil dispenser of claim 1, wherein the shroud is formed from a strip of elastic steel and wherein the shroud comprises a base face for attaching the shroud to the lower bar of the cutting assembly, a stop face located below the sharp cutting edge of the cutting blade, said overlapping face that bends towards the cutting blade; a contact face that separates an unwound foil from a rolled foil sheet, and a bend ridge located between the overlapping face and the contact face.

4. The rolled foil dispenser of claim 1, wherein the back wall of the container body and the base flat face have means for placing the rolled foil dispenser on a wall mount frame so as to form a vertical dispenser system.

5. The rolled foil dispenser of claim 1, wherein the base flat face has a slotted perforation and means for securing the rolled foil dispenser in a vertical dispenser system in a horizontal position.

6. A wall mount frame for housing a plurality of rolled foil dispensers of claim 1, wherein the wall mount frame comprises a plurality of pivoting latches; wherein a number of the plurality of pivoting latches is equal to a number of the plurality of rolled foil dispensers; and wherein each of the plurality of pivoting latches comprises a pivot, a knob and a flat latching arm to engage with a corresponding rolled foil dispenser of the plurality of rolled foil dispensers.

7. The wall mount frame of claim 6 further comprising a channel formed from a flat stainless steel sheet and a plurality of channel legs, each channel leg having a catch and a ledge; wherein the channel has perforations that allow attachment of the wall mount frame to a wall; wherein the catch of each of the plurality of channel legs engages with a corresponding back wall of the plurality of rolled foil dispensers; and wherein the ledge of each of the plurality of channel legs supports a corresponding base flat face of the plurality of rolled foil dispensers.

8. The rolled foil dispenser of claim 1, wherein the grooves of the round shaft body of the shaft assembly are concentrically spaced at 120 degrees from one another.

9. A vertical dispensing system comprising a wall mount frame and a plurality of rolled foil dispensers of claim 1, wherein each of the plurality of rolled foil dispensers is mounted on the wall mount frame through a respective slot of a respective base flat face.

* * * * *